United States Patent [19]

Brunn

[11] Patent Number: 4,730,142

[45] Date of Patent: Mar. 8, 1988

[54] COLOR PICTURE TUBE

[75] Inventor: Otto Brunn, Wernau, Fed. Rep. of Germany

[73] Assignee: Standard Elektrik Lorenz A.G., Stuttgart, Fed. Rep. of Germany

[21] Appl. No.: 908,315

[22] Filed: Sep. 17, 1986

[30] Foreign Application Priority Data

Sep. 20, 1985 [DE] Fed. Rep. of Germany ..... 3533564

[51] Int. Cl.[4] ..... H01J 29/07

[52] U.S. Cl. ..... 313/402; 313/406

[58] Field of Search ..... 313/402, 404, 405, 406, 313/407

[56] References Cited

U.S. PATENT DOCUMENTS

| | | | |
|---|---|---|---|
| 2,899,578 | 8/1959 | Vincent | 313/406 |
| 2,922,063 | 1/1960 | Haas | 313/406 |
| 3,700,949 | 10/1972 | Watanabe et al. | 313/405 |
| 4,506,188 | 3/1985 | Puhak | 313/405 |
| 4,644,222 | 2/1987 | Brunn | 313/406 |

FOREIGN PATENT DOCUMENTS 3125095 3/1982 Fed. Rep. of Germany .

*Primary Examiner*—David K. Moore
*Assistant Examiner*—Sandra L. O'Shea
*Attorney, Agent, or Firm*—Peter C. Van Der Sluys

[57] ABSTRACT

The shadow mask of a color picture tube is connected to studs in the faceplate via hold members. To secure the hold members in position, screw or pressfit fasteners are inserted into the free ends of the studs. The heads of the fasteners force the hold members against the studs.

8 Claims, 4 Drawing Figures

COLOR PICTURE TUBE

BACKGROUND OF THE INVENTION

The invention pertains to a color picture tube.

German Pat. No. 31 25 095 discloses a color picture tube in which studs for supporting the shadow mask are fused into the rim of the faceplate at such an angle that their longitudinal axes extend parallel in relation to the electron beam deflected towards the respective corner. The free ends of the studs are of conical design, and the hold members are oblong and of one piece. To securely hold the hold members on the studs, two-part clamping members are used.

SUMMARY OF THE INVENTION

It is one object of the invention to provide a color picture tube with a simpler arrangement for securely holding the hold members on the studs.

In accordance with the invention the shadow mask of a color picture tube is connected to studs in the faceplate via hold members. To secure the hold members in position, screw or pressfit fasteners are inserted into the free ends of the studs. The heads of the fasteners force the hold members against the studs.

BRIEF DESCRIPTION OF THE DRAWING

The invention will be better understood from a reading of the following detailed description in conjunction with the drawing in which.

DETAILED DESCRIPTION

Figure 1:
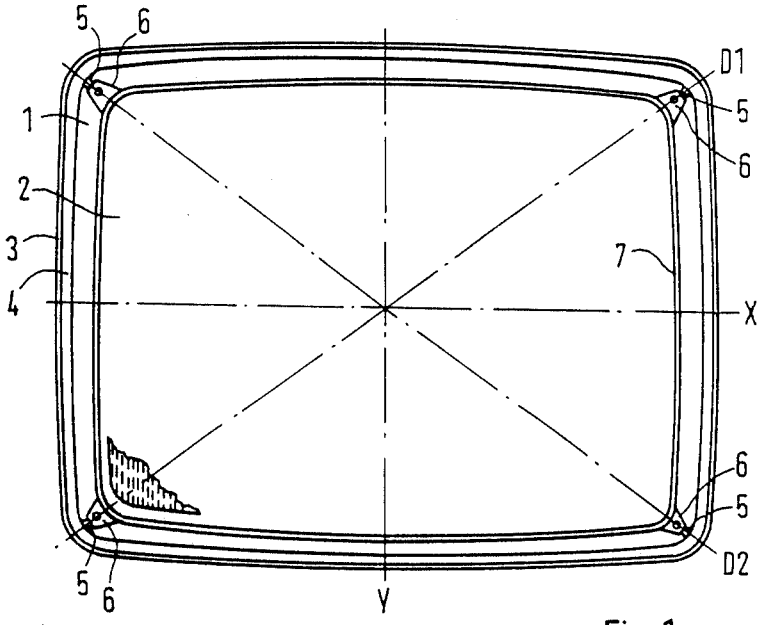
Fig.1 (PRIOR ART)
FIG. 1 is a top view of a faceplate with an inserted shadow mask.

FIG. 1 shows only the faceplate 1 with the inserted shadow mask 2 of a conventional color picture tube. The figure shows the X axis, the Y axis and the diagonals D1 and D2. The seal edge on the rim portion 4 of the faceplate 1 is indicated by the reference numeral 3. Faceplate 1 carried a phosphor layer (not shown) on its inside. At the point of intersection of the diagonals D1 and D2 with the rim portion 4 of the faceplate 1, studs 5 are provided which carry the shadow mask via hold members 6. The hold members 6 engage the rim portion 7 of the shadow mask 2.

At the point of intersection of the X axis with the Y axis, the axis of symmetry of the color picture tube is perpendicular to the plane of the paper. The hold members for the shadow mask may alternatively be provided at the intersection of the X and the Y axes with the rim portion 7 of the shadow mask 2 and the rim portion 4 of the faceplate 1.

Figure 2:
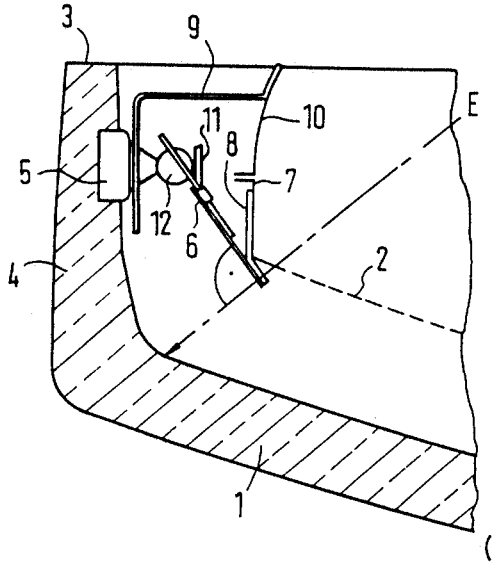
Fig.2 (PRIOR ART)
FIG. 2 is a section of the lower left hand corner of the faceplate of FIG. 1.

As shown in FIG. 2, one end of stud 5 is fused into the rim portion 4 of the faceplate 1. Stud 5 is inserted into rim portion 4 so as to be vertical relative to the tube axis. However, the studs can also be aligned in a different manner. The free end of stud 5 carries two-part hold member 6 which is connected via a corner reinforcement 8 to rim portion 7 of shadow mask 2. Hold member 6 is so aligned as to be perpendicular to the electron beam E deflected into this corner. Moreover, stud 5 carries a support bracket 9 to whose free end the magnetic shielding 10 of the color picture tube is mounted. A locking element 11 which forces the free end of hold member 6 against stud 5 is inserted into the free end 12 of stud 5.

Figure 3:
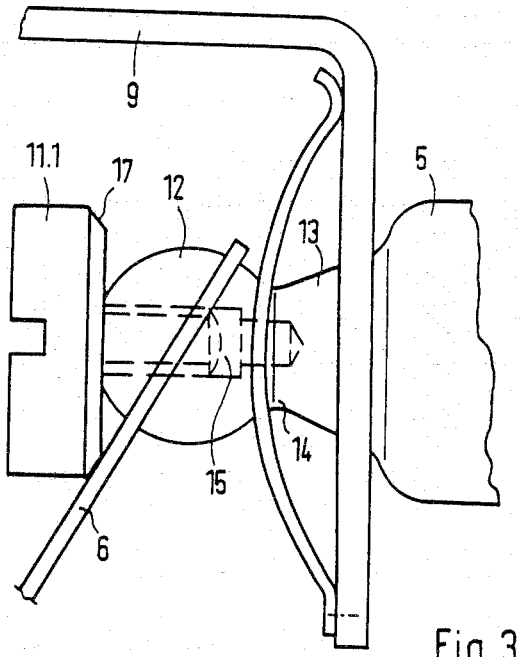
FIG. 3 is an enlarged part of FIG. 2 with a cap screw as the locking element.

FIG. 3 is an enlarged representation of a locking element 11 in accordance with the invention. Stud 5, which has one end fused into the rim portion of the faceplate, after emerging from the rim portion, changes into a conical part 13 which carries the spherical end of stud 5. The diameter of the spherical end 12 is larger than the smaller diameter of the conical part 13, so that a constriction 14 exists between conical part 13 and spherical end 12. Hold member 6, which is held in position by locking element 11, rests on the spherical end 12. Other shapes of the free ends, e.g., a conical shape, are also possible.

In this embodiment, locking element 11 is a cap screw 11.1. Cap screw 11.1 is screwed into a threaded blind hole 15 in the free end of stud 5. The edge of the head of the cap screw 11.1 thus touches hold member 6 and forces it against the spherical end of the stud 5. This edge of the cap screw is chamfered at such an angle that the surface 17 thus formed is parallel to the surface of hold member 6.

Figure 4:
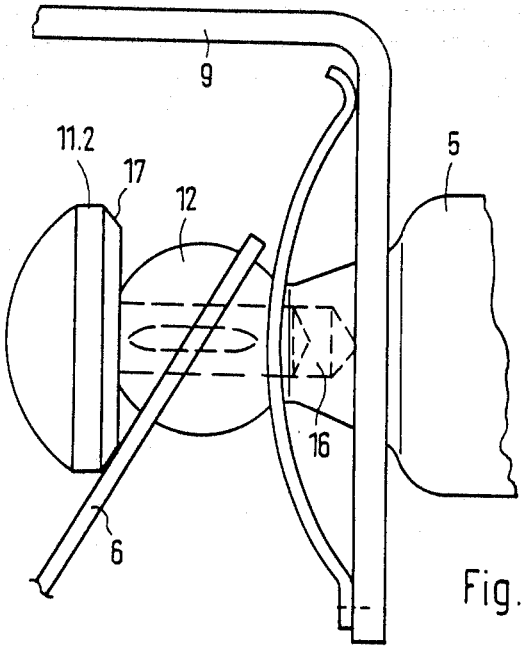
FIG. 4 shows a second embodiment of the locking element.

The second embodiment of locking element 11, shown in FIG. 4, is a notched pin 11.2. The notched pin 11.2 is pressed into a blind hole 16 at the free end 12 of the stud 5. The head of the notched pin 11.2 thus forces against the hold member 6 and maintains it on the spherical end 12 of the stud 5. The edge of the head of the notched pin 11.2, which touches the hold member 6, is chamfered at such an angle that the surface 17 thus formed is parallel to the surface of the hold member 6.

With a locking element 11 in accordance with the invention, a simple and low-cost device is provided for securing the hold members against unhooking. This safeguard is less susceptible to overload than locking springs are. Furthermore, the compressive forces produced vary within narrower limits.

What is claimed is:

1. A color tube, comprising:

a faceplate;

a funnel having a neck, said funnel being attached to said faceplate;

studs having one end attached in the corners of said faceplate and a free end a shadow mask;

hold members connected to said shadow mask and engaging said studs; and screw fasteners screwed into the free ends of said studs so as to hold said hold members to said studs.

2. A color picture tube in accordance with claim 1, wherein:

said screw fasteners are cap screws.

3. A color picture tube in accordance with claim 2, wherein:

the heads of said cap screws are arranged to force said hold members against said studs.

4. A color picture tube in accordance with claim 3, wherein:

said heads each include a surface portion in contact with and parallel to a surface of the hold member held thereby.

5. A color tube, comprising:

a faceplate;

a funnel having a neck, said funnel being attached to said faceplate;

studs having one end attached in the corners of said faceplate and a free end;

a shadow mask;

hold members connected to said shadow mask and engaging said studs; and pressfit fasteners pressed into the free ends of said studs so as to hold said hold members to said studs.

6. A color picture tube in accordance with claim 5, wherein:

said pressfit fasteners are notched pins.

7. A color picture tube in accordance with claim 6, wherein:

the heads of said notched pins are arranged to force said hold members against said studs.

8. A color picture tube in accordance with claim 7, wherein:

said heads each include a surface portion in contact with and parallel to a surface of the hold member held thereby.

* * * * *